US007438525B2

(12) United States Patent
Chang et al.

(10) Patent No.: US 7,438,525 B2
(45) Date of Patent: Oct. 21, 2008

(54) FAN HOUSING

(75) Inventors: Pei-Yu Chang, Taoyuan Hsien (TW); Tsu-Liang Lin, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 202 days.

(21) Appl. No.: 11/296,375

(22) Filed: Dec. 8, 2005

(65) Prior Publication Data

US 2007/0048123 A1 Mar. 1, 2007

(30) Foreign Application Priority Data

Aug. 24, 2005 (TW) ..... 94128840 A

(51) Int. Cl.
*F01D 1/02* (2006.01)

(52) U.S. Cl. ..... 415/211.2

(58) Field of Classification Search ..... 415/119, 415/213.1; 361/695; 454/184
See application file for complete search history.

(56) References Cited

U.S. PATENT DOCUMENTS

| | | | | |
|---|---|---|---|---|
| 2,628,018 | A * | 2/1953 | Koch | 415/186 |
| 2,950,859 | A * | 8/1960 | Kirk | 417/363 |
| 7,184,268 | B2 * | 2/2007 | Espinoza-Ibarra et al. | 361/695 |
| 7,230,826 | B2 * | 6/2007 | Kyle et al. | 361/695 |

* cited by examiner

*Primary Examiner*—Edward Look
*Assistant Examiner*—Devin Hanan
(74) *Attorney, Agent, or Firm*—Birch, Stewart, Kolasch & Birch, LLP

(57) ABSTRACT

A fan housing and a fan have stationary blades for guiding airflow. Each stationary blade has at least one airflow-guiding element extending therefrom along the circumference of the fan. The side wall of the airflow-guiding element changes the direction of the airflow so that the airflow at the outlet is fully introduced toward the heat source. Furthermore, the airflow-guiding element regulates the airflow, restrains the turbulent flow at the outlet and on the curved surface of the stationary blade, decreases the noise arising from the turbulent flow, and prevents foreign matter from entering the fan housing so as to protect the inside elements thereof.

22 Claims, 7 Drawing Sheets

FAN HOUSING

BACKGROUND

The invention relates to a fan housing and a fan provided with stationary blades for guiding airflow, and in particular, to a fan housing and a fan provided with airflow-guiding elements extending out from wing-shaped stationary blades.

Referring to FIG. 1, a conventional axial fan housing 1 includes a frame 10, a base 11 disposed in the frame 10, and a plurality of stationary blades 12 disposed between the frame 10 and the base 11. Further referring to FIG. 2, during rotation of fan blades 2, mounted in the fan housing 1, turbulent flow is generated at the airflow outlet of the fan housing 1 due to rotational inertia. Furthermore, airflow does not naturally concentrate. Thus, the airflow produced by the fan blades 2 fails to effectively dissipate heat from a heat source. Such a situation is more serious particularly when the fan blades operate under high back pressure, wherein turbulent flow is generated along the curved surface of the stationary blade 12 as shown in FIG. 3. In this situation, the fan blades 2 may lose speed, the airflow may fail to effectively do work, and excessive noise is generated.

Thus, a fan housing capable of effectively guiding airflow and preventing turbulent flow is desirable.

SUMMARY

To solve the described problems, the invention provides a fan housing and a fan which has stationary blades for guiding airflow. Each stationary blade has at least one airflow-guiding element extending there from along the circumference of the fan. The side wall of the airflow-guiding element changes the direction of the airflow so that the airflow at the outlet is fully introduced toward the heat source. Furthermore, the airflow-guiding element is capable of regulating the airflow, restraining the turbulent flow at the outlet and on the curved surface of the stationary blade, and decreasing the noise arising from the turbulent flow.

A fan in accordance with an exemplary embodiment of the invention includes a fan housing and an impeller disposed in the fan housing. The fan housing includes a frame, a base disposed in the frame, a plurality of stationary blades disposed between the frame and the base, and at least one airflow-guiding element extending from the stationary blades along the circumference of the base. The stationary blade is wing-shaped and includes an upper curved surface and a lower curved surface. The airflow-guiding element extends out from the upper curved surface or the lower curved surface. Furthermore, the airflow-guiding element is spaced apart from the adjacent stationary blade. In operation, the side wall of the airflow-guiding element guides the airflow and changes the direction of the airflow, thereby restraining the turbulent flow at the airflow outlet of the fan housing and on the curved surface of the stationary blade. The noise arising from the turbulent flow is also reduced. Moreover, the airflow-guiding element can prevent foreign matter from entering the fan housing so as to protect the inside elements thereof.

BRIEF DESCRIPTION OF THE DRAWINGS

The invention can be more fully understood by reading the subsequent detailed description and examples with references made to the accompanying drawings, wherein.

DETAILED DESCRIPTION

Figure 1:
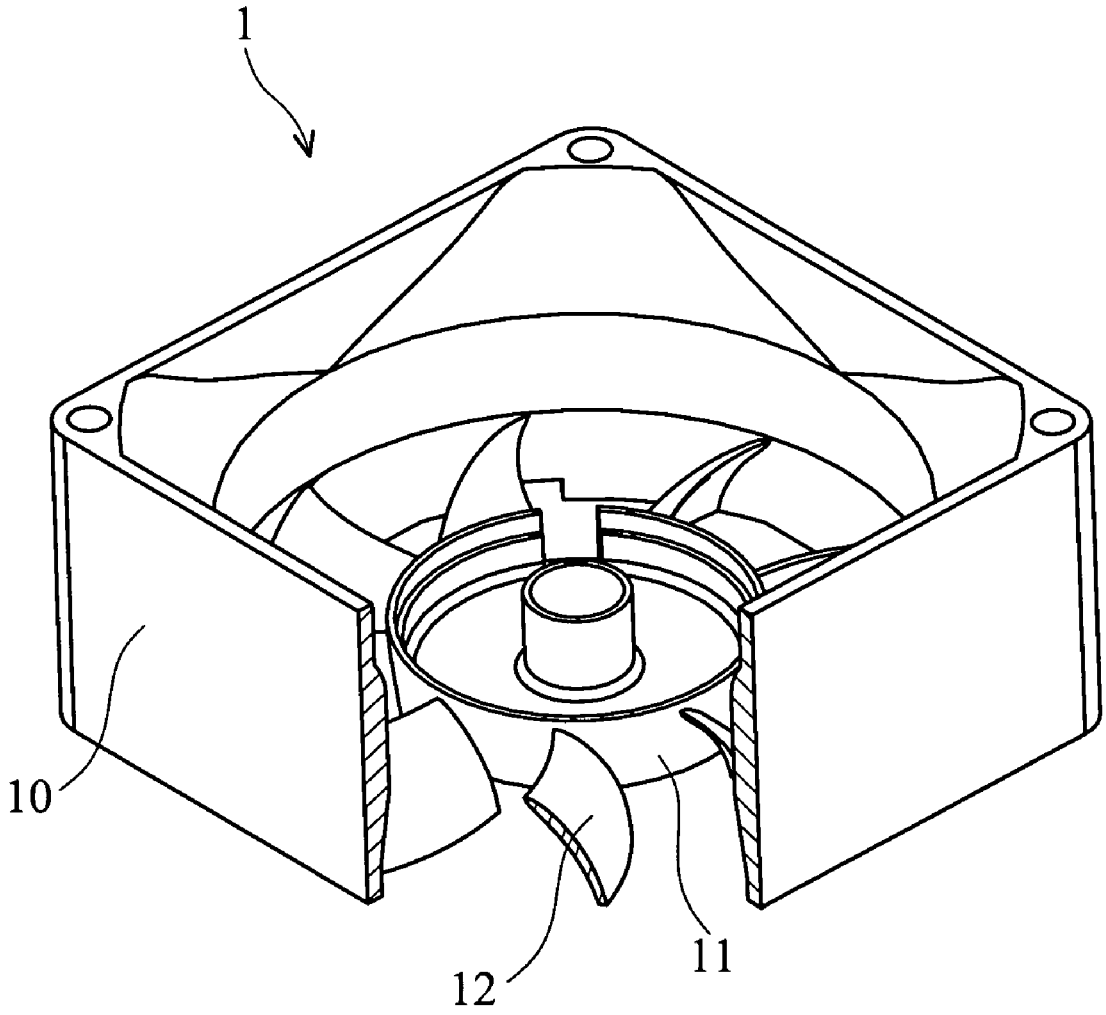
FIG. 1 (RELATED ART)
FIG. 1 is a perspective view of a conventional axial fan housing, with a part thereof removed.
Figure 2:
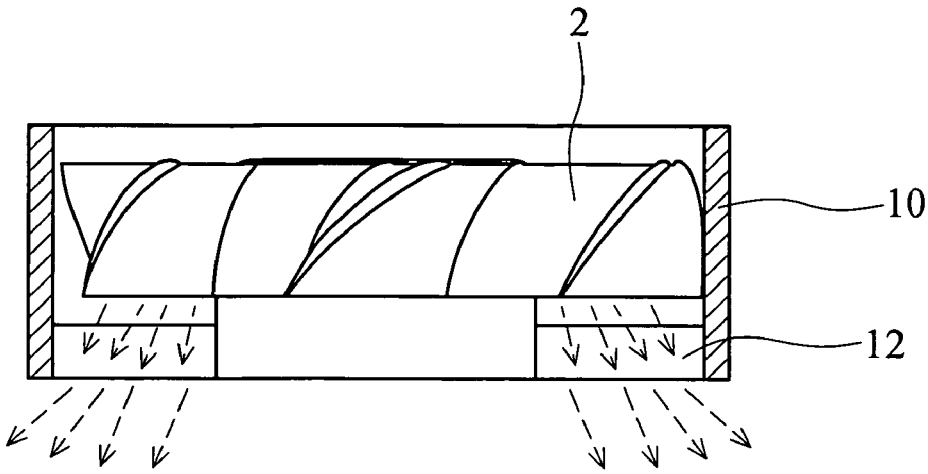
FIG. 2 (RELATED ART)
FIG. 2 depicts the direction of the airflow generated by the conventional axial fan.
Figure 3:
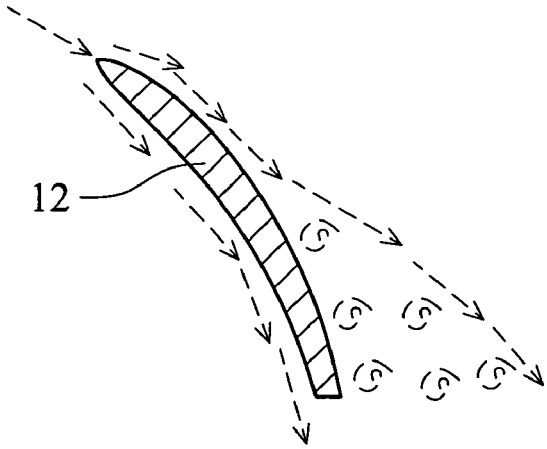
FIG. 3 (RELATED ART)
FIG. 3 depicts the flow field near the curved surface of a stationary blade of the conventional axial fan.
Figure 4:
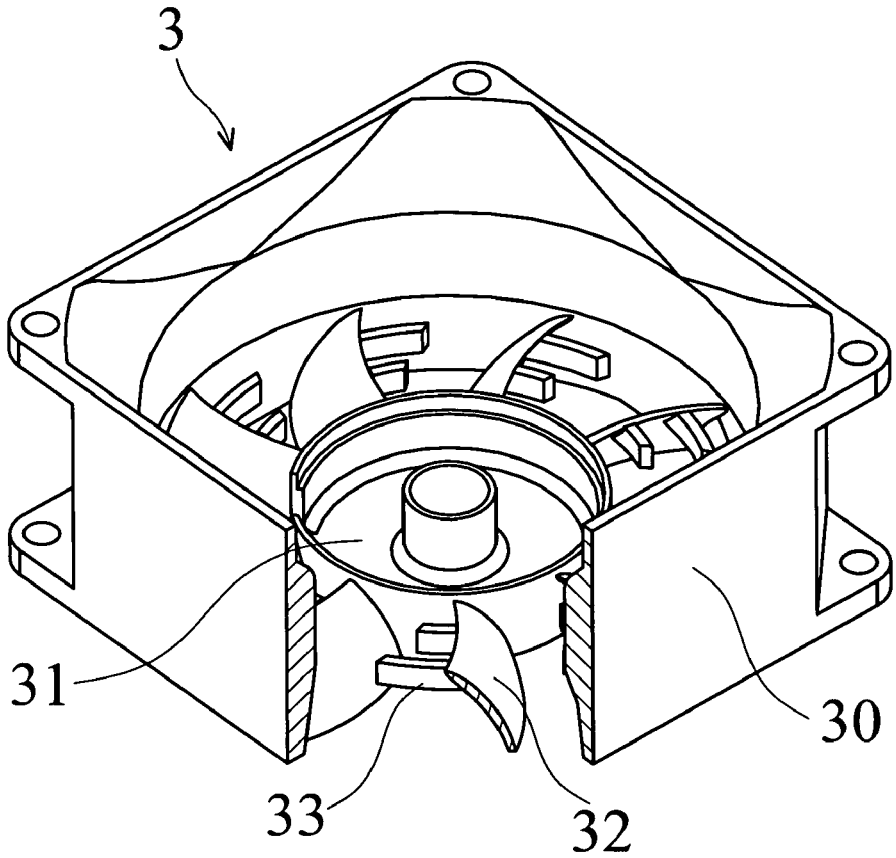
FIG. 4 is a perspective diagram of a fan housing in accordance with an embodiment of the invention, wherein the airflow-guiding element extends from the top of the lower curved surface of the stationary blade.
Figure 5:
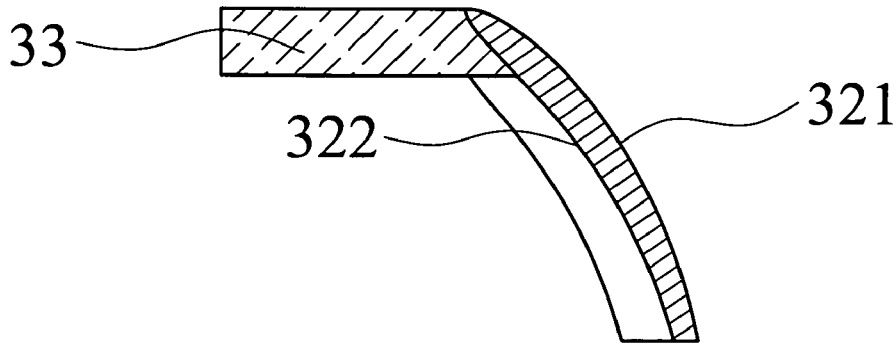
FIG. 5 is a sectional view of the stationary blade and airflow-guiding element of FIG. 4.

Referring to FIGS. 4 and 5, a fan housing 3 in accordance with an embodiment of the invention includes a frame 30, a base 31, a plurality of stationary blades 32, and a plurality of airflow-guiding elements 33. The stationary blades 32 can be supporting element 32. The frame 30 is substantially square. The base 31 is round and disposed in the frame 30. The stationary blades 32 are disposed between the frame 30 and the base 31. The airflow-guiding elements 33 are mounted on the stationary blades 32 along the circumference of the base 31 and are immovably connected with the supporting elements 32 (stationary blades 32). In this embodiment, each stationary blade 32 has two airflow-guiding elements 33 extending therefrom.

The stationary blade 32 is wing-shaped and has an upper curved surface 321 and a lower curved surface 322. The airflow-guiding elements 33 are stick-shaned as shown in FIG. 4 and extend out from the top of the lower curved surface 322.

The airflow-guiding elements 33 are in the path of airflow. To avoid an excessive influence on the airflow by the airflow-guiding elements 33, each airflow-guiding element 33 and the adjacent stationary blade 32 are spaced apart allowing airflow to pass there between.

Figure 6:
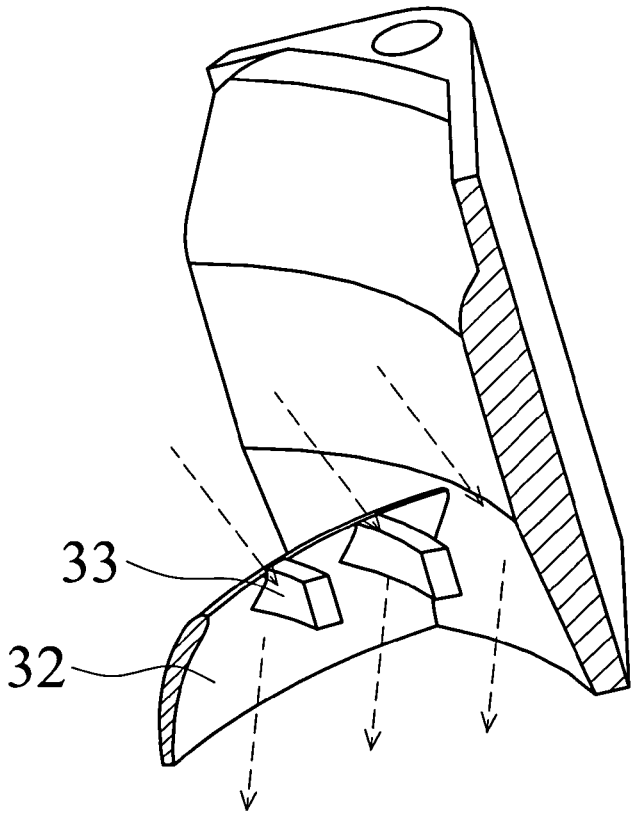
FIG. 6 depicts the airflow passing through the stationary blade and airflow-guiding element of FIG. 4.
Figure 7:
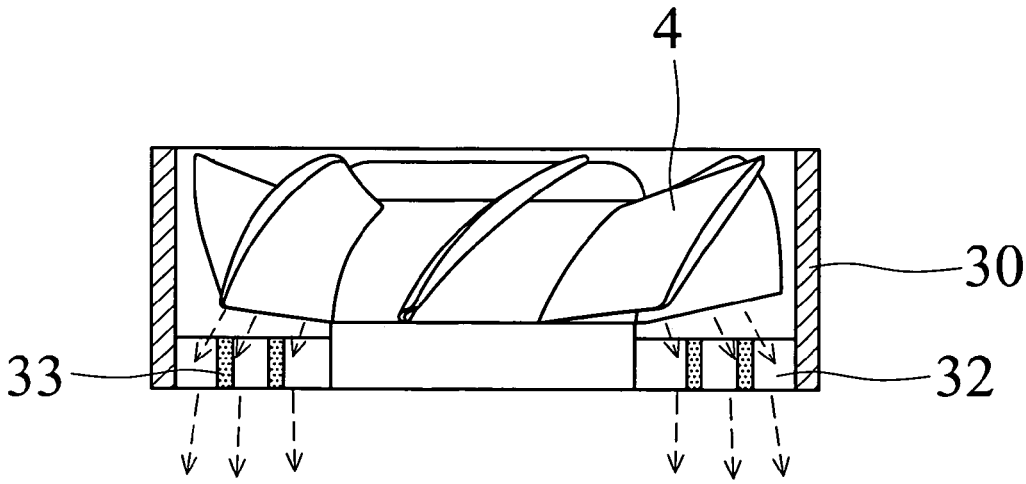
FIG. 7 depicts the direction of the airflow generated by the axial fan of the invention.

Referring to FIGS. 6 and 7, when upward-extending fan blades 4 are rotated to generate airflow, the airflow-guiding elements 33 guide the airflow and change the direction of the airflow, thereby restraining the turbulent flow at the airflow outlet of the fan housing 3 and on the curved surface of the stationary blade 32. The noise arising from the turbulent flow is also decreased. Moreover, the airflow-guiding elements 33 can prevent foreign matter (not shown) from entering the fan housing 3 so as to protect the inside elements thereof.

Figure 8:
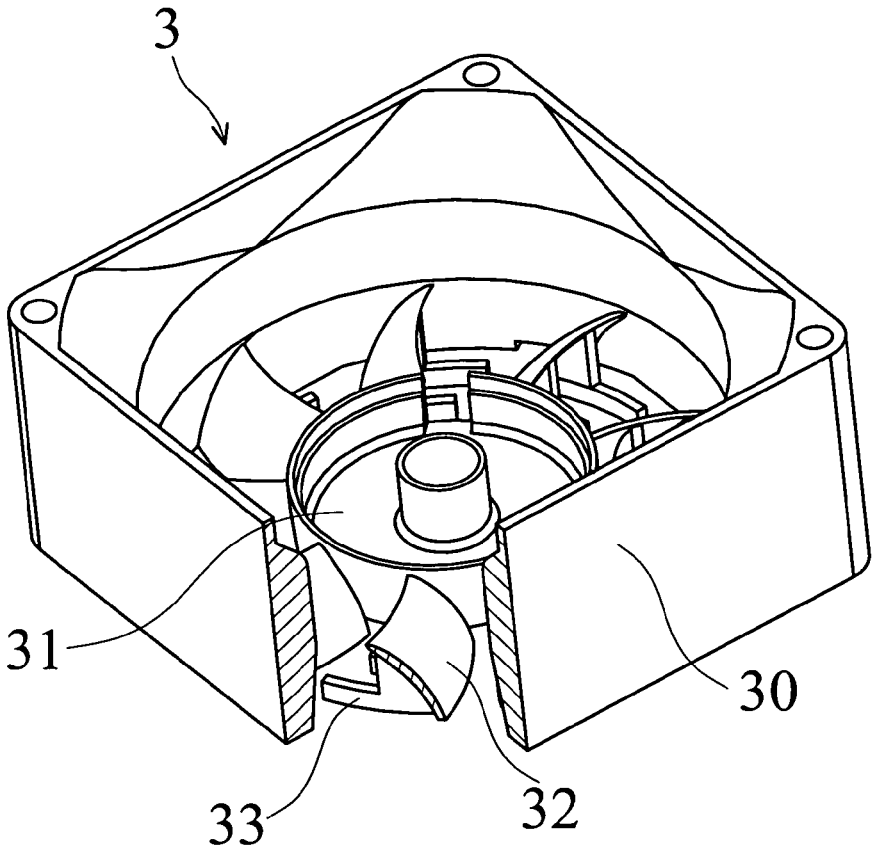
FIG. 8 is a perspective diagram of a fan housing in accordance with another embodiment of the invention, wherein the airflow-guiding element extends from the lower curved surface of the stationary blade.
Figure 9:
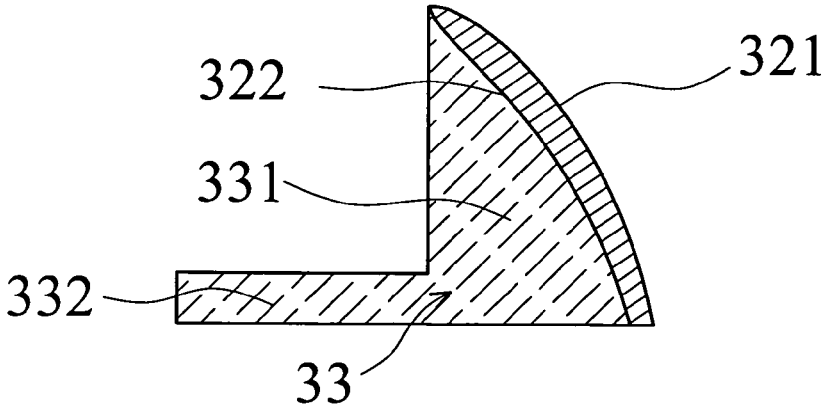
FIG. 9 is a sectional view of the stationary blade and airflow-guiding element of FIG. 8.

Referring to FIGS. 8 and 9, in another embodiment of the invention, each airflow-guiding element 33 includes a reinforcing part 331 and a guide part 332. The reinforcing part 331 is connected to the lower curved surface 322 of the stationary blade 32. The guide part 332 extends out from the bottom of the reinforcing part 331. The reinforcing part 331 enhances the mechanical strength of the airflow-guiding element 33 and increases the area of the side wall of the airflow-guiding element 33. Thus, airflow is fully guided by the side wall of the airflow-guiding element 33 and then exits from the fan housing 3 in the same direction.

Figure 10:
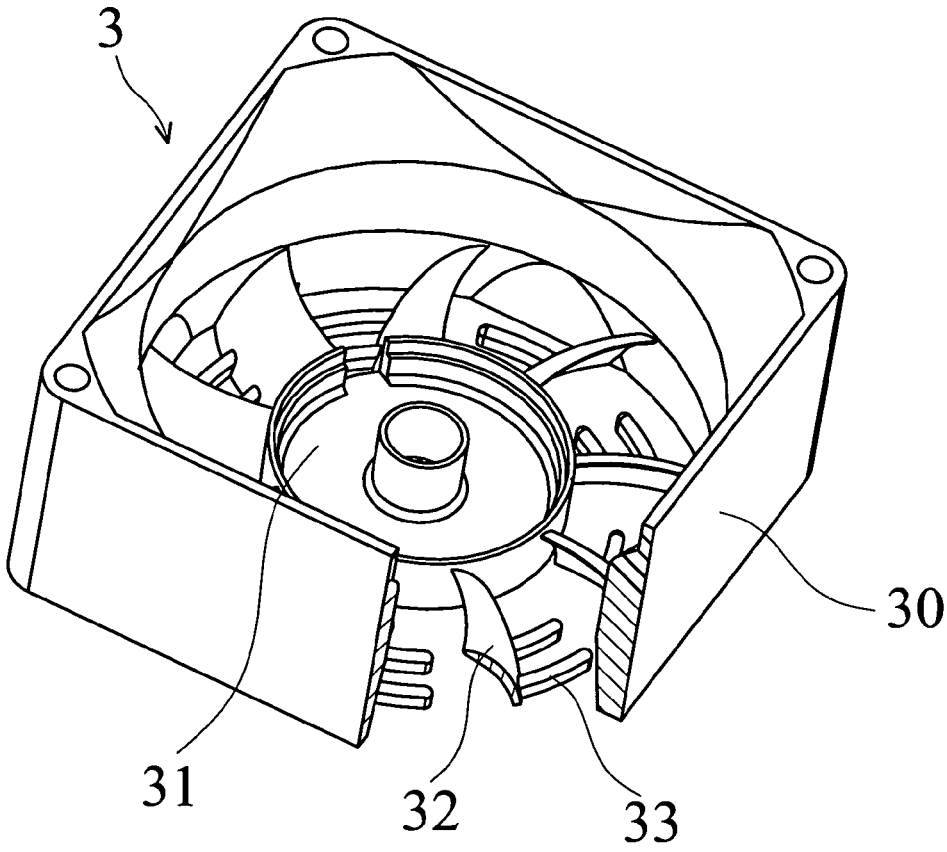
FIG. 10 is a perspective diagram of a fan housing in accordance with another embodiment of the invention, wherein the airflow-guiding element extends from the bottom of the upper curved surface of the stationary blade.
Figure 11:
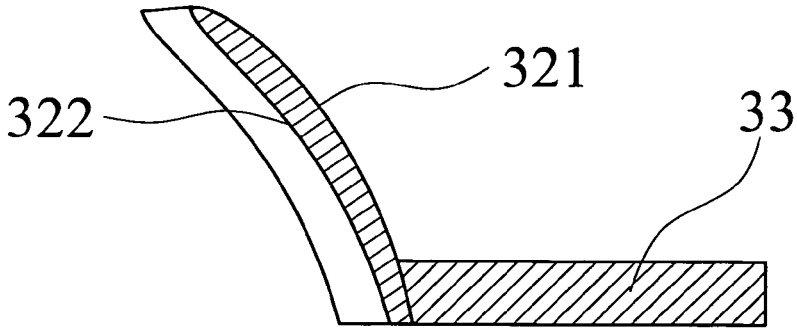
FIG. 11 is a sectional view of the stationary blade and airflow-guiding element of FIG. 10.

Because airflow is capable of moving along the upper curved surface 321 and the lower curved surface 322, the design in which the airflow-guiding element 33 mounted on the upper curved surface 321 is feasible. For example, the airflow-guiding element 33 shown in FIGS. 10 and 11 extends from the bottom of the upper curved surface 321 of the stationary blade 32. It is also understood that the airflow-guiding element 33 may extend from the top of the upper curved surface 321 of the stationary blade 32. In any arrangement, the airflow is regulated in the same manner and description thereof is therefore omitted.

Figure 12:
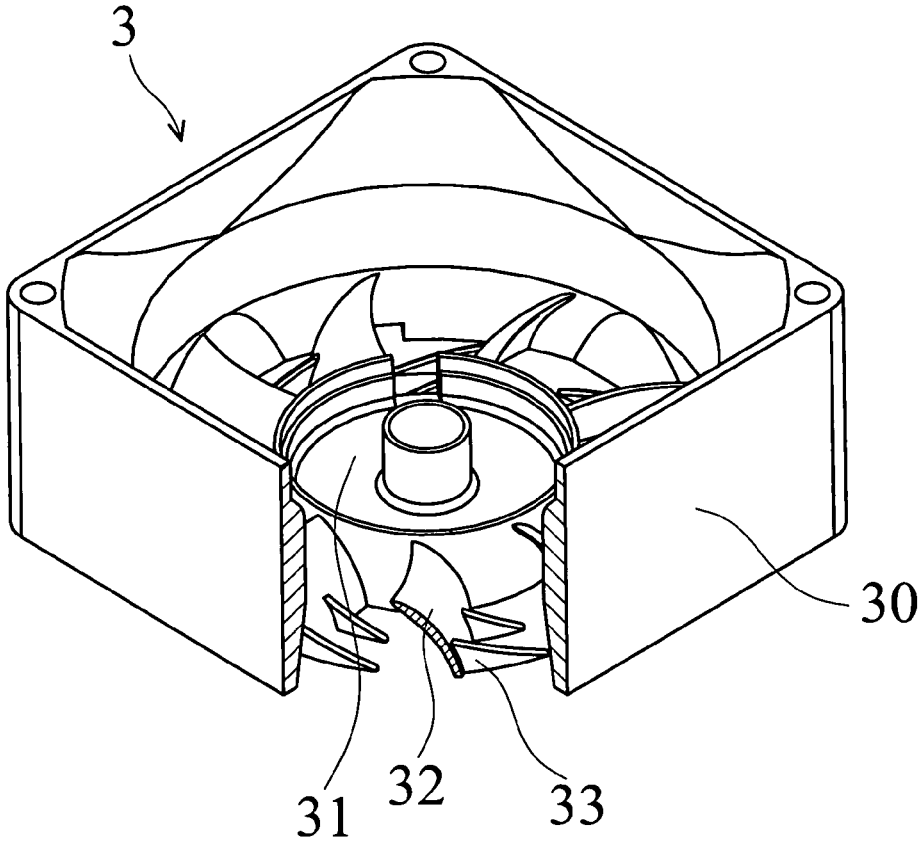
FIG. 12 is a perspective diagram of a fan housing in accordance with another embodiment of the invention, wherein the airflow-guiding element extends from the upper curved surface of the stationary blade.
Figure 13:
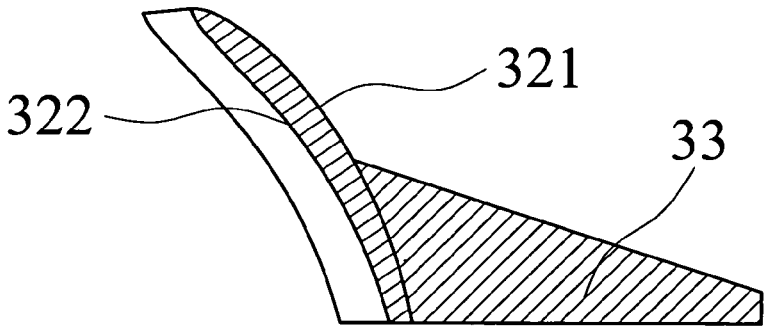
FIG. 13 is a sectional view of the stationary blade and airflow-guiding element of FIG. 12.

The invention provides at least one airflow-guiding element on each stationary blade. The side wall of the airflow-guiding element is capable of effectively guiding the airflow. Therefore, qualifying the shape and size of the airflow-guiding element is not necessary. As shown in FIGS. 12 and 13, the airflow-guiding element 33 is mounted on the upper curved surface 321 of the stationary blade 32. The area of the side wall is increased to enhance the performance of the airflow-guiding element 33. The airflow-guiding element 33 has an inclined surface facing the airflow to decrease the loss of airflow. The size and shape of the airflow-guiding element depend on the size and shape of the blades and the direction and amount of airflow. However, a decrease in the amount of airflow due to improper size and shape is not allowed.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan housing comprising:

a frame;

a base disposed in the frame;

a plurality of supporting elements disposed between the frame and the base; and a plurality of airflow-guiding elements fixed on the supporting elements, wherein the airflow-guiding elements are immovably connected with the supporting elements, each supporting element has at least one airflow-guiding element extending from a surface thereof, and the at least one airflow-guiding element is spaced apart from another supporting element adjacent to the supporting element from which the at least one airflow-guiding element extends out.

2. The fan housing as claimed in claim 1, wherein the airflow-guiding elements extend along the circumference of the base.

3. The fan housing as claimed in claim 1, wherein each supporting element is wing-shaped and comprises an upper curved surface and a lower curved surface.

4. The fan housing as claimed in claim 3, wherein the airflow-guiding element extends out from the lower curved surface.

5. The fan housing as claimed in claim 3, wherein the airflow-guiding element extends out from the upper curved surface.

6. The fan housing as claimed in claim 1, wherein the airflow-guiding element comprises a reinforcing part and a guide part.

7. The fan housing as claimed in claim 6, wherein the reinforcing part is connected to the supporting element, and the guide part extends out from the reinforcing part.

8. The fan housing as claimed in claim 1, wherein the airflow-guiding element comprises an inclined surface facing airflow and matching the direction of the airflow.

9. The fan housing as claimed in claim 1, wherein a side wall of the airflow-guiding element contacts and guides airflow.

10. The fan housing as claimed in claim 1, wherein each supporting element has two airflow-guiding elements extending therefrom.

11. A fan, comprising:

a fan housing comprising:

a frame;

a base disposed in the frame;

a plurality of supporting elements disposed between the frame and the base; and a plurality of airflow-guiding elements fixed on the supporting elements, wherein the airflow-guiding elements are immovably connected with the supporting elements; and an impeller disposed in the fan housing, wherein each supporting element has at least one airflow-guiding element extending from a surface thereof, and the at least one airflow-guiding element is spaced apart from another supporting element adjacent to the supporting element from which the at least one airflow-guiding element extends.

12. The fan as claimed in claim 11, wherein the supporting elements are stationary blades or ribs.

13. The fan as claimed in claim 11, wherein the airflow-guiding element extends along the circumference of the base.

14. The fan as claimed in claim 11, wherein the supporting element is wing-shaped and comprises an upper curved surface and a lower curved surface, and the airflow-guiding element extends out from the lower curved surface or the upper curved surface.

15. The fan as claimed in claim 11, wherein the airflow-guiding element comprises a reinforcing part and a guide part, the reinforcing part is connected to the supporting element, and the guide part extends out from the reinforcing part.

16. The fan as claimed in claim 11, wherein the airflow-guiding element comprises an inclined surface facing airflow and matching the direction of the airflow.

17. The fan as claimed in claim 11, wherein the impeller comprises a plurality of oblique-extending blades.

18. The fan as claimed in claim 11, wherein the airflow-guiding elements are stick-shaped.

19. A fan housing, comprising:

a frame;

a base disposed in the frame;

a plurality of supporting elements disposed between the frame and the base; and a plurality of airflow-guiding elements mounted on the supporting elements, wherein each supporting element has at least one airflow-guiding element extending from a surface thereof, and each airflow-guiding element comprises a reinforcing part and a guide part.

20. The fan housing as claimed in claim 19, wherein the reinforcing part is connected to the supporting element, and the guide part extends out from the reinforcing part.

21. The fan housing as claimed in claim 19, wherein at least one airflow-guiding element is spaced apart from another supporting element adjacent to the supporting element from which the at least one airflow-guiding element extends out.

22. The fan housing as claimed in claim 21, wherein each supporting element has two airflow-guiding elements extending therefrom.

* * * * *